US005325985A

United States Patent [19]

Radtke

[11] Patent Number: 5,325,985

[45] Date of Patent: Jul. 5, 1994

[54] GASKET WITH A SELF-SUPPORTING PROTRUSION

[75] Inventor: Charles S. Radtke, Little Ferry, N.J.

[73] Assignee: Precision Valve Corporation, Yonkers, N.Y.

[21] Appl. No.: 140,966

[22] Filed: Oct. 25, 1993

Related U.S. Application Data

[63] Continuation of Ser. No. 814,370, Dec. 26, 1991, abandoned.

[51] Int. Cl.[5] ..... B65D 53/00

[52] U.S. Cl. ..... 220/378; 220/308; 220/358; 220/614; 215/341; 215/346

[58] Field of Search ..... 220/378, 307, 308, 356, 220/357, 358, 614, 612, 613; 215/341, 345, 346, 232

[56] References Cited

U.S. PATENT DOCUMENTS

| | | | |
|---|---|---|---|
| 1,682,234 | 8/1928 | Moyer | 215/345 |
| 2,772,012 | 11/1956 | Crabtree | 215/40 |
| 3,342,381 | 9/1967 | Simons et al. | 220/614 X |
| 3,344,943 | 10/1967 | Zipper | 215/346 |
| 3,443,006 | 5/1969 | Simons et al. | 215/352 X |
| 3,570,704 | 3/1971 | Roson | 220/204 |
| 3,979,015 | 9/1976 | Arfert | 220/307 |
| 4,094,460 | 6/1978 | Scanga et al. | 215/232 X |
| 4,547,948 | 10/1985 | Abplanalp | 220/614 X |
| 4,621,964 | 11/1986 | Radtke et al. | 220/614 X |

FOREIGN PATENT DOCUMENTS

| | | | |
|---|---|---|---|
| 563586 | 3/1983 | Australia | 220/614 |
| 0033626 | 12/1981 | European Pat. Off. | 220/614 |
| 117162 | 7/1969 | Norway | 215/346 |

OTHER PUBLICATIONS

Laminated Mounting Cup Sold By Precision Valve Corporation.

*Primary Examiner*—Gary E. Elkins
*Attorney, Agent, or Firm*—Davis Hoxie Faithfull & Hapgood

[57] ABSTRACT

A gasket for sealing a channel of a mounting cup to a container bead including at least one protrusion at an end of the gasket for retaining the mounting cup in position on a container bead prior to clinching. Six such protrusions can be equidistantly positioned about the gasket. A gasketed mounting cup including such protrusions is also disclosed. A method for manufacturing such a gasketed mounting cup is disclosed as well.

23 Claims, 6 Drawing Sheets

GASKET WITH A SELF-SUPPORTING PROTRUSION

This is a continuation of copending application Ser. No. 07/814,370 filed on Dec. 26, 1991 now abandoned.

BACKGROUND

Aerosol dispensing containers have found widespread use in the packaging of fluid materials including a variety of both liquid and powdered particulate products. Such containers are provided with a valve-controlled discharge orifice and operate by the action of a volatile propellant which is confined within the container together with the product to be dispensed. Because the propellant has an appreciable vapor pressure at room temperature, the product in the closed container is maintained under superatmospheric pressure.

A typical aerosol unit comprises a hollow cylindrical container which is tightly closed at one end and is provided with an opening at its opposite end for receiving a dispensing valve assembly. A closure, commonly referred to as a mounting cup, serves as the closure for the container and as a support for the valve assembly. Typically, the mounting cup comprises a pedestal portion for mounting the valve unit, a panel portion extending from the pedestal portion, a skirt portion depending from the periphery of the panel, and an annular channel portion extending outwardly from the skirt. When the mounting cup is placed in sealing position on the container, the channel is positioned over the bead surrounding the container opening and the lower portion of the skirt adjacent to the channel is flared or clinched outwardly against the underside of the bead. To ensure adequate sealing between the closure and the container, the cup is provided with a gasket in the channel, or predominantly in the channel, of the cup.

In U.S. Pat. Nos. 4,546,525 ("the 525 patent") and 4,547,948 ("the 948 patent"), a novel gasketed mounting cup system, including novel method and apparatus, is described wherein the gasket material is disposed on the mounting cup in the preferred position for effecting a seal between the mounting cup and the bead of the container, in an exceptionally rapid and efficient manner to form gasketed-mounting cups having excellent sealing characteristics. In general, the method of invention of the '525 and '948 patents comprises passing a tubular sleeve of gasket material onto a compressible mandrel; initially positioning and aligning the skirt of the mounting cup and the contiguous end of the mandrel such that the sleeve of gasket material may pass onto the skirt, said mandrel having fixed and moveable portions with respect to each other and to their movement toward and away from the mounting cup; urging the moveable portion of the gasket material bearing mandrel toward the mounting cup such that the gasket material passes onto the skirt of the cup; causing the moveable portion of the mandrel to retract to its initial position, cutting the sleeve at a point between the mounting cup and the mandrel to leave a band of gasket material; and subsequently, advancing the mounting cup to a station whereat the band of the gasket material is urged further onto the skirt of the mounting cup, whereby the band of gasket material does not extend beyond the skirt of the mounting cup. Subsequently, the gasket is advanced to the ultimately desired position partially within the channel of the mounting cup. The '525 and '948 patents are incorporated by reference herein.

In the United States, aerosol containers are typically filled by the undercap filling method. First, the product to be dispensed is deposited into the container. Then a mounting cup, including the valve and dip tube, is placed on the container such that the bead of the container is within the channel of the mounting cup. The filling head of an undercap filling machine then encompasses the top of the container, creating an airtight seal. Air is then evacuated from the container. The suction created during evacuation raises the mounting cup off of the container bead. Propellant is then forced into the container opening beneath the mounting cup and the mounting cup is repositioned and clinched to the container bead. In certain applications, the propellant can be dissolved in the product, mixed and inserted into the container in one step. Product saturated carbon dioxide is one common example.

During the filling process, suction during evacuation or the force of the propellant during filling can displace the gasket from its position within the channel of the mounting cup, preventing a proper seal on clinching. In some cases, the gasket can be completely displaced by the propellant filling the container, forcing the gasket into the container. This is referred to as a "blown" gasket.

The dip tube of the container is usually slightly longer than the height of the container to insure that its end is positioned at the bottom of the container. As shown in FIG. 1, when the mounting cup is positioned on the container bead, the dip tube is slightly bent. This can provide an upward force which can displace the mounting cup from the container bead, interfering with proper clinching. To ensure that the mounting cup is maintained on the container bead prior to clinching, protrusions are created around the skirt of the mounting cup which are below the container bead when the mounting cup is in position. Such protrusions 14*a* are also shown in FIG. 1. The force provided by the bent dip tube is generally insufficient to overcome the retaining force provided by the protrusions. The protrusions are formed by a tool placed around the pedestal of the mounting cup, which forces out particular sections of the skirt of the cup.

Such protrusions can scratch the container bead or walls of the opening of the container when the mounting cup is being positioned, promoting corrosion. In addition, the mounting cup can be split or punctured during formation of the protrusion.

SUMMARY OF THE INVENTION

In accordance with the broadest aspects of the present invention, a gasket and a gasketed mounting cup include means for securing the gasket to a container bead prior to filling, the means being disposed on a portion of the gasket contiguous to the skirt portion of the gasketed mounting cup. In another aspect of the invention, the means secures the mounting cup to the container bead prior to filling. The means preferably comprises one or more protrusions in the gasket material.

A method for producing the gasket and gasket material is also disclosed wherein gasket material is positioned on the mounting cup such that a first portion of the gasket is in contact with the channel of the mounting cup and a second portion is in contact with the skirt of the mounting cup. A protrusion formed in the second portion of the gasket material. A punch having a plurality of lugs equidistantly positioned to form a plurality of protrusions is preferably used.

Figure 8:
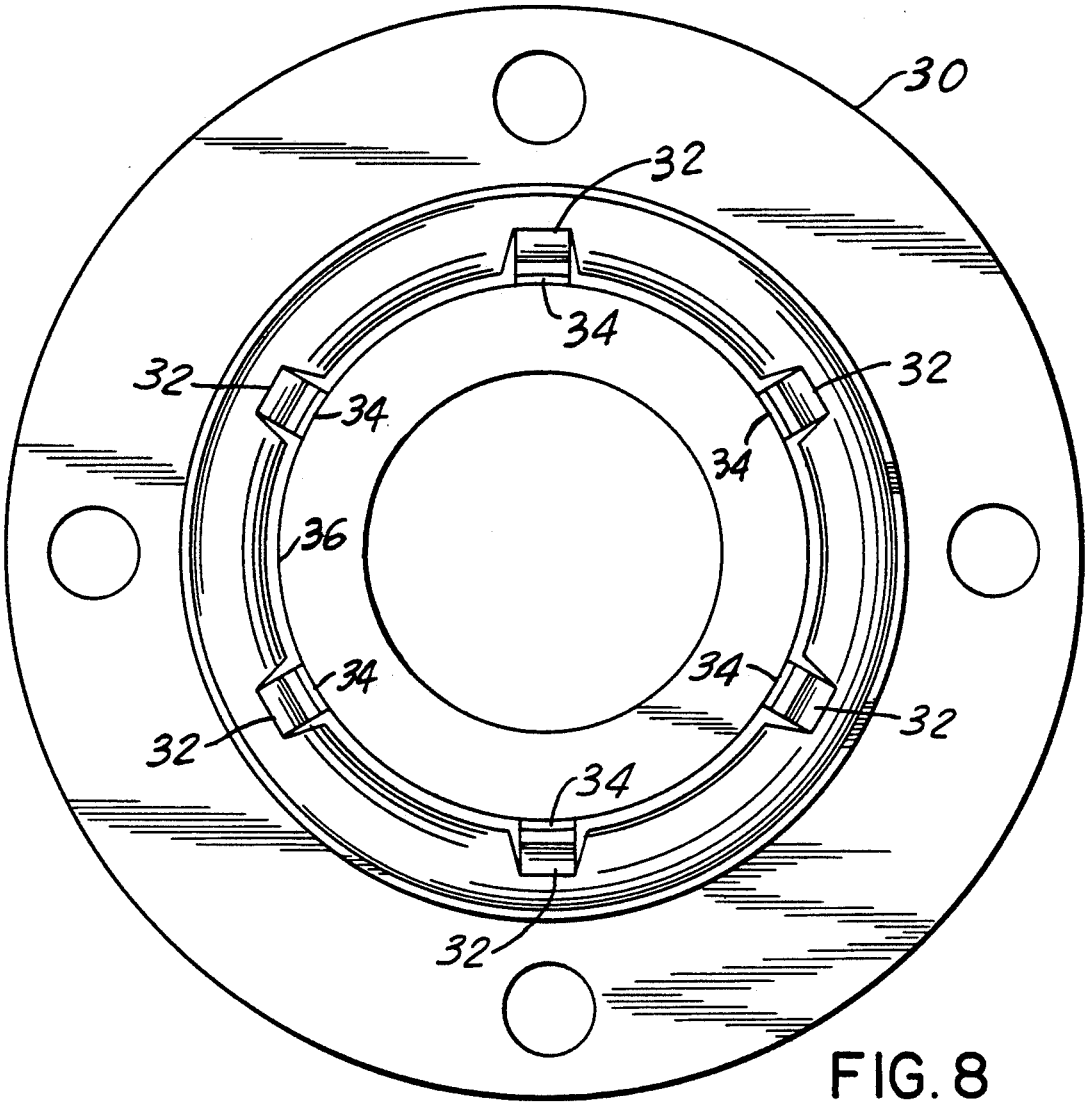

FIGS. *7a–7c* are partial cross-sectional views of various steps in the method of positioning the gasket and forming the protrusion in accordance with the present invention;

FIG. 8 is a bottom view of the punch shown in FIGS. *7a–c*; and

Figure 9:
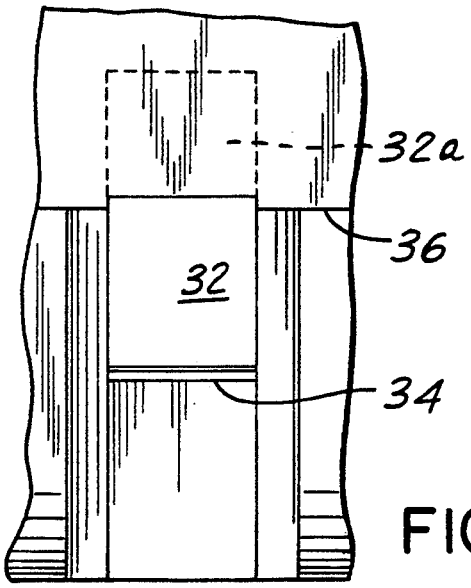

FIG. 9 is a front view of one lug of the punch shown in the FIGS. *7a–c*.

DESCRIPTION OF THE INVENTION

Figure 1:
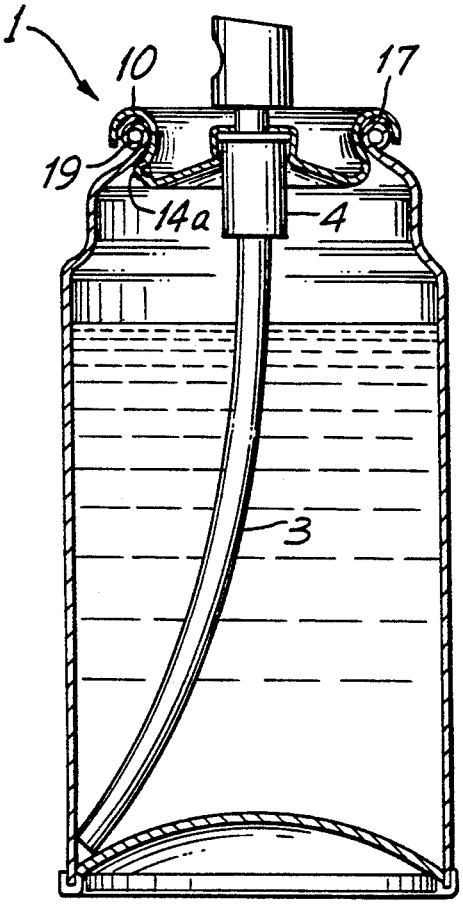
PRIOR ART FIG. 1
FIG. 1 is a partial cross-sectional view of an aerosol container of the prior art.

FIG. 1 is a partial cross-sectional view of an aerosol container 1 showing a mounting cup 10 positioned on a container bead 19. A dip tube 3 extends from the valve 4 in the mounting cup 10 to the bottom of the container 1. The dip tube is slightly longer than the height of the container and is therefore slightly bent by the bottom of the container.

Figure 2A:
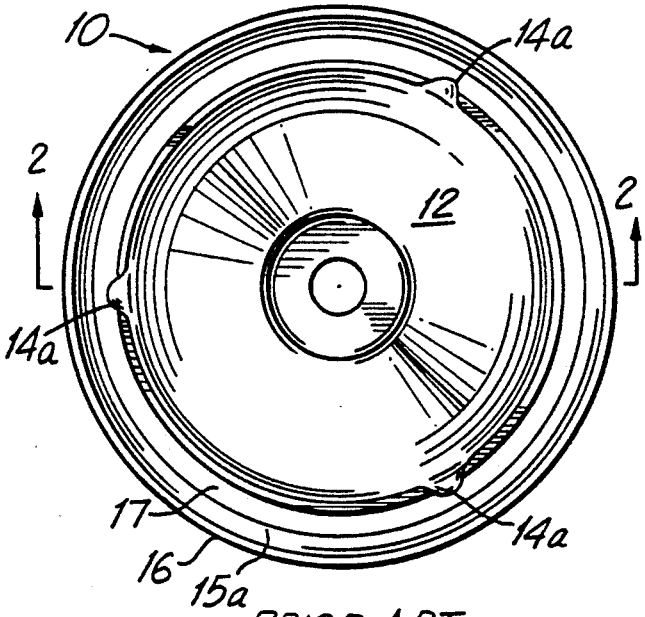
PRIOR ART FIG. 2a
FIG. 2*a* is a top view of the mounting cup of FIG. 2.
Figure 2:
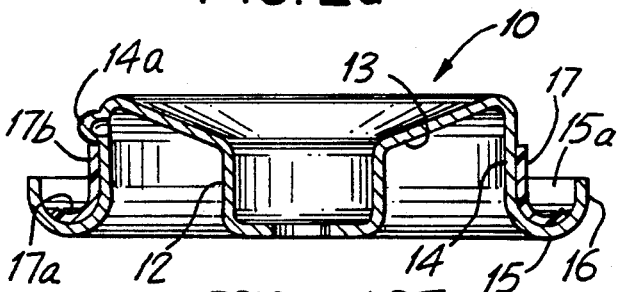
PRIOR ART FIG. 2
FIG. 2 is a side cross-sectional view of a gasketed mounting cup of the prior art.

FIG. 2 shows a typical aerosol valve mounting cup of the prior art generally designated as 10. The mounting cup has a pedestal portion 12 which depends from the interior edge of a panel portion 13. A skirt 14 depends from the exterior edge of the panel portion 13 opposite the pedestal portion and is concentric thereto. The top portion of the skirt 14 curves into a channel portion 15 which terminates in an edge portion 16. The channel portion 15, edge portion 16 and skirt 14 form an annular concave receptor 15*a* for receiving the standard bead of an aerosol container, such as the container 1 of FIG. 1. The gasket material 17 has a first portion 17*a* within the channel portion 15 of the mounting cup 10 for engaging the container bead 19 of container 1 for example. The gasket material 17 also has a second portion 17*b* in contact with the skirt 14 of the mounting cup 10. Also shown is a protrusion 14*a* in the skirt 14. A plurality of such protrusions 14*a* can be arranged around the skirt as shown in FIG. 2*a*, which is a top view of the mounting cup 10 of FIG. 2. The protrusions 14*a* maintain the mounting cup and valve assembly in position on a container bead prior to clinching.

Figure 3:
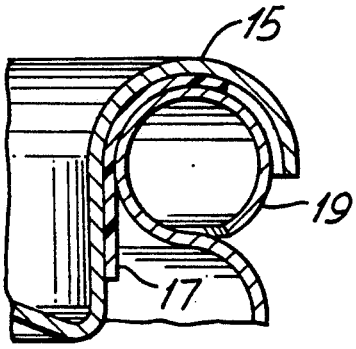
PRIOR ART FIG. 3
FIG. 3 is a cross-sectional view of a portion of a container bead within the channel of the mounting cup.

FIG. 3 shows the container bead 19 of the container 1 within the annular concave receptor 15*a* of the mounting cup 10 of FIG. 1. The mounting cup has not yet been clinched to the container bead.

Figure 4:
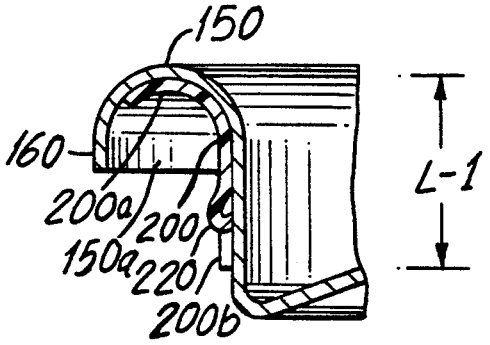
FIG. 4 is a partial cross-sectional view of the gasket and gasketed mounting cup of the present invention.
Figure 5:
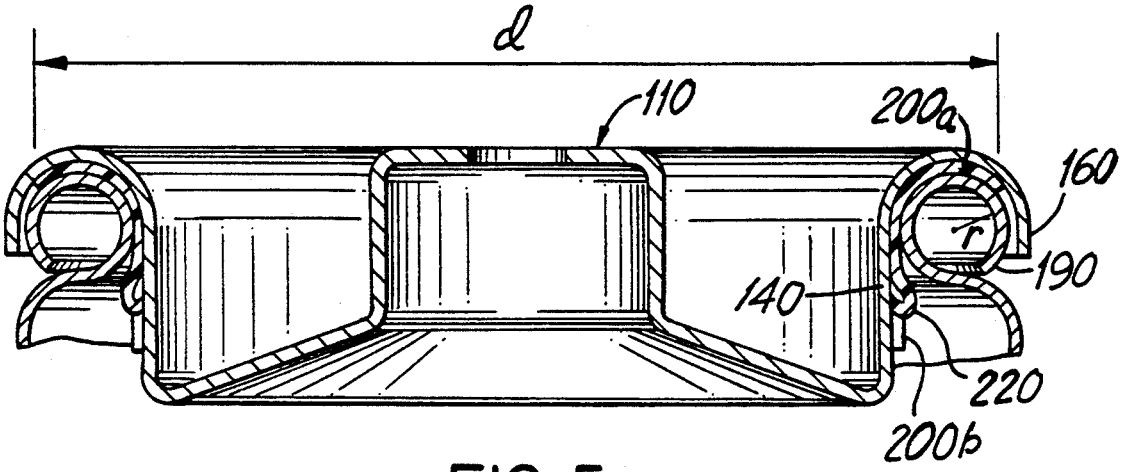
FIG. 5 is a cross-sectional view of the gasketed mounting cup of the present invention positioned on a container bead.

FIG. 4 shows a cross-sectional view of the annular concave receptor portion 150*a* of a mounting cup 110, with a gasket 200 made in accordance with the invention. The mounting cup 110 of FIG. 5 is the same as mounting cup 10 in FIG. 2. FIG. 5 is a cross-sectional view of the gasketed mounting cup of the invention positioned on the container bead 190 of a container 1 such as in FIG. 1. The gasket 200 has a first portion 200*a* located within the annular concave receptor portion 150*a* for engaging the container bead 190 in FIG. 5, for example. The gasket 200 also has a second portion 200*b* contiguous to the skirt 140 of the mounting cup 110. The second portion 170*b* of the gasket 110 has an inner surface 174 in contact with the skirt of the mounting cup and an outer surface 176. The gasket includes in its second portion 200*b*, means for securing the gasketed mounting cup to a container bead 190 prior to filling. This means is preferably a protrusion 220 formed at the end of the second portion 200*b* of the gasket 200. The protrusion 220 extends outwardly from this surface. The view of FIGS. 4 and 5 are through the protrusions 220. The protrusions 220 resists the upward force exerted by the dip tube 3, as shown in FIG. 1, retaining the mounting cup in position on the container bead 19 as shown in FIG. 1. The protrusions do not prevent the lifting of the gasket 110 off the container bead by the suction generated during the evacuation phase of the undercap filling process.

The skirt 140 of the mounting cup 110 is smooth, which for the purposes of this specification means that the surface is free of deformations, such as the protrusions 14*a* shown in FIGS. 1–2, which can deform the outer surface of the gasket 200. An important advantage of the present invention is that it avoids the use of such protrusions 14*a*.

Figure 6:
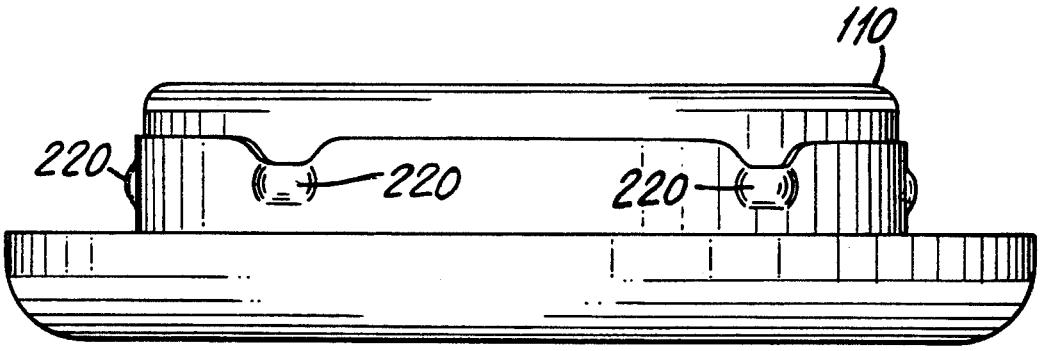
FIG. 6 is a side view of the gasketed mounting cup of the present invention.
Figure 6A:
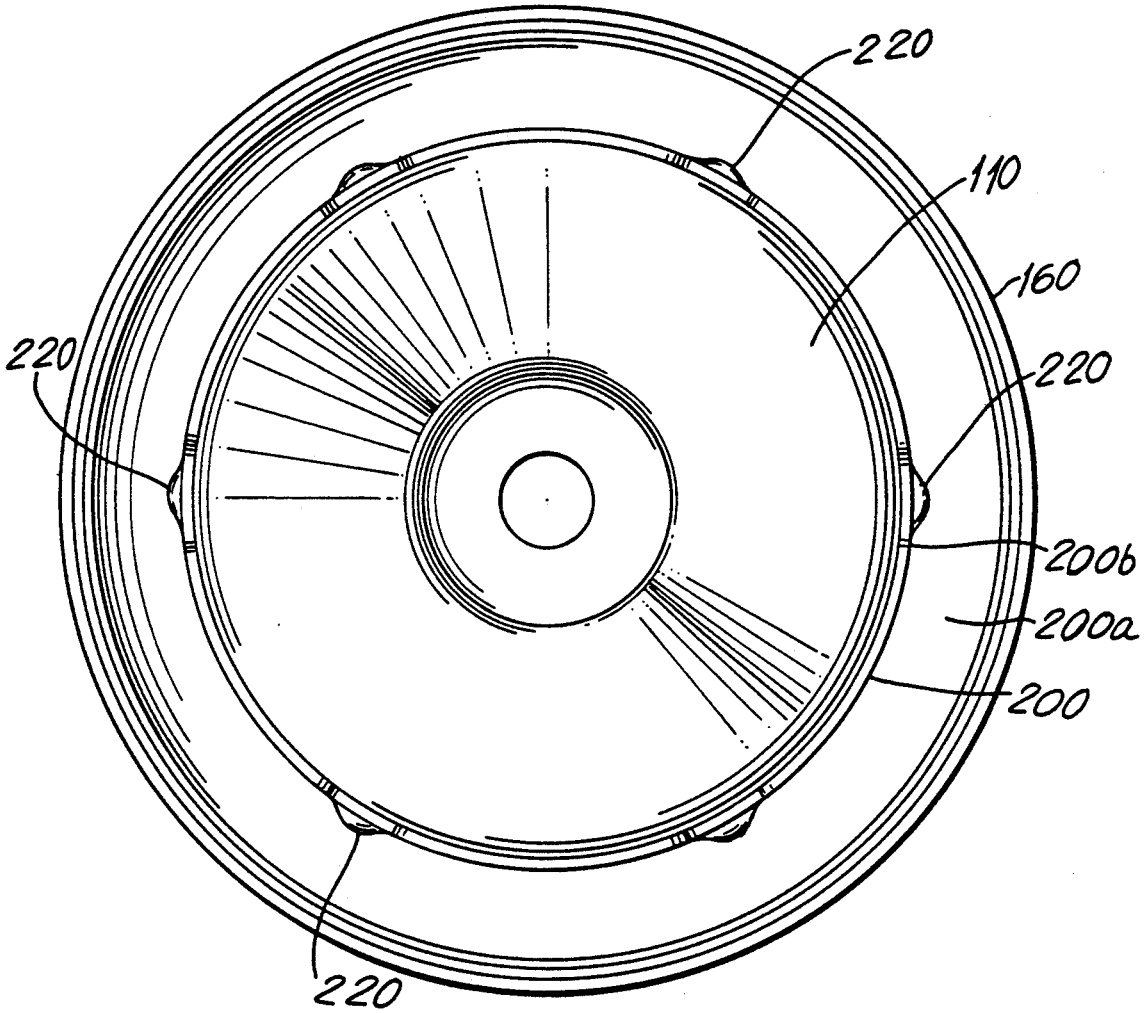
FIG. 6*a* is a top view of the gasketed mounting cup of FIG. 6.

At least one such protrusions is provided. Preferably, there are a plurality of such protrusions arranged symmetrically about the gasket, as shown in FIGS. 6 and 6*a*. FIG. 6 is a side view of the gasketed mounting cup 110 of the present invention, with a gasket 200 in position. FIG. 6*a* is a top view of the gasketed mounting cup of FIG. 6. Satisfactory results have been obtained with the use of six such protrusions equidistantly spaced around the second portion 200*b* of the gasket 200.

The gasket material 200 is preferably formed from a sleeve gasket and the protrusion 220 is preferably formed by slightly folding over a portion of the end of the second portion 200*b* of the gasket material 200 during advancement of the gasket into the channel of the mounting cup, which is discussed in more detail, below. The cross-section of the sleeve should be smooth. Thinned areas can interfere with the integrity of the seal and cause displacement of the gasket prior to clinching. Visual inspection of the sleeve is sufficient to ensure that there are no such thinned areas.

Figure 5A:
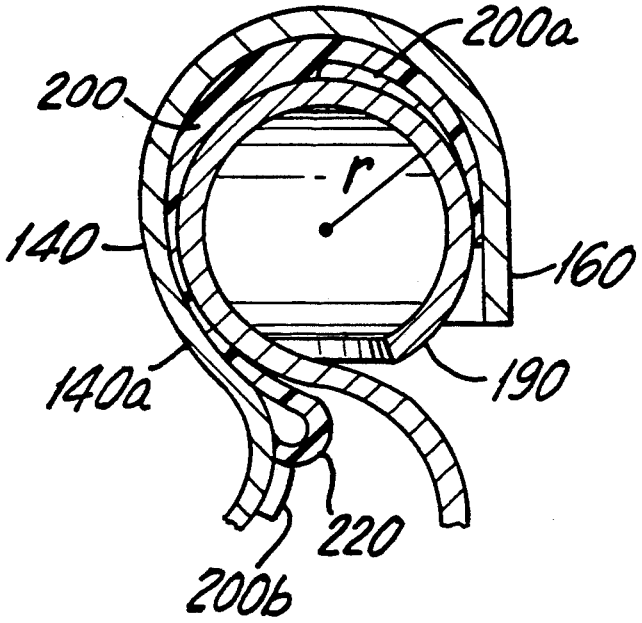
FIG. 5*a* is a cross-sectional view of the gasketed mounting cup of FIG. 5, clinched to the container bead.

The mounting cup 110 is preferably a standard mounting cup for use in a standard one inch opening of an aerosol container. The radius "r" of the bead 12 of the container is 0.06 inches. Optimum ranges for certain critical dimensions for the gasket's 200 position on the mounting cup 110 have been ascertained, as described in U.S. Ser. No. 07/814,113, filed on the same day as the present case and assigned to the same assignee. In such a standard cup, the length "L-1" of the gasket as measured from the center of the channel 150 of the mounting cup to the end of the second portion 200*b* is preferably at least 0.150 inches and is most preferably about 0.175 inches. L-1 is shown in FIG. 4. It has been found that for optimum sealing, it is necessary to have sealing material in the region between the skirt 140 and the container bead 190 proximate numeral "140*a*" in FIG. 5*a*. These preferred lengths ensure that the second portion 200*b* of the gasket material 200 is properly positioned along the skirt 140 of the mounting cup 11 to provide sealing material in this critical region. If the radius "r" of the container bead 190 is larger than 0.06 inches, a larger length L-1 would be required. If the radius "r" is smaller than 0.06 inches, a shorter length L-1 would be acceptable.

The gasket material 200 should be positioned far enough into the channel 150 of the mounting cup 110 such that the diameter "d" of the gasket flare, as measured at the end of the first portion 200*a* of the gasket 200 through the center of the mounting cup 110, as shown in FIG. 5, is preferably greater than about 1.100 inches. It is more preferably greater than about 1.180 inches. It is more preferably about 1.200 inches. Such a flare diameter places the end of the first portion 24*a* of the gasket 20 at approximately the 10 o'clock position within the annular convex receptor shown in FIG. 4. Such placement of the gasket shows improved resistance to dislodgement from the channel 20 of the mounting cup 10.

To achieve the preferred flare diameter, the length "L-2" of the gasket material after being cut from the sleeve (as described in the '525 and '948 patents), referred to as its "cut length, should be between about 0.250–0.285 inches. See FIG. 7*a*.

The gasket 20 is preferably between about 0.013–0.016 inches thick. It is most preferably 0.014 inches thick.

The gasket can also comprise a mixture of a first plastic material providing sufficient stiffness to maintain the gasket in position partially within the channel 180 of the mounting cup 110 and a softer plastic material providing sufficient softness to provide a reliable seal between the channel 150 of the mounting cup 110 and the container bead 190 when clinched such that the mixture has a flexural modulus, 1% secant, of at least about 70,000 psi, as measured by ASTM method D 790, and preferably at least about 90,000 psi. The mixture has a hardness no greater than about 60 Shore D, as measured by ASTM method D 2240, and is preferably 56 or less. Generally, the stiffer material will have higher density than the softer material. If the gasket is the preferred sleeve gasket, the polymers forming the mixture are preferably thermoplastics. The mixture should have sufficient resistance to environmental stress to withstand the pressure and compression forces endured by aerosol container gaskets. Environmental stress crack resistance of at least about 400 is preferred. The plastic must be resistant to cold flow, as well.

The preferred stiffer material is HDPE having a flexural modulus of at least about 140,000 psi. A higher flexural modulus is even more preferred. The preferred HDPE is Altaven TM 6200B HDPE, available from Plastics Del Logo, C.A. Venezuela. Preferably, the LLDPE has a hardness no greater than about 55 and more preferably no greater than about 50. The preferred LLDPE is DNDA-7340 Natural 7 ("DNDA-7340"), available from Union Carbide.

Typical property data for the preferred HDPE and LLDPE appear below:

| | Altaven TM 6200B | | |
|---|---|---|---|
| Properties | Covenin Method | ASTM Method | Typical Value |
| Melt Index | 1552 | D 1238 | 0.40 g/10 min |
| Density | — | D 1505 | 0.0958 g/cm$^3$ |
| Yield strength | 1357 | D 638 | 280 Kg/cm$^2$ |
| Tensile strength at break | 1357 | D 638 | 320 Kg/cm$^2$ |
| Elongation at break | 1357 | D 638 | >500% |
| Izod Impact strength | 822 | D 256 | 12 Kg. cm/cm |
| Environmental cracking resistance | — | D 693 | >400 hours |
| Flexural Modulus 1% Secant | | D 790 | 145,000 |
| Hardness | | D 2240 | ~66 |

| | DNDA-7340 | |
|---|---|---|
| Properties | Test Method | Typical Values |
| Melt Index | D 1238 | 0.4389 |
| Benzylamine | 0.3305 | |
| $SiO_2$ dispersion | 0.4264 | |
| Activator solution | 2.0993 | |
| Solder powder (from Extramet) | 25.8912 | |

With the preferred HDPE and LLDPE described above, mixtures within the range of about 62%–52% LLDPE to about 38%–48% HDPE are preferred. A mixture of 57% by weight of the DNDA-7340, 43% by weight of the Altaven TM 6200B, is currently being used.

In most aerosol applications, product is inserted into the container prior to the propellant. When propellant is inserted in the undercap filling method described generally above, the propellant is at high pressure. In such cases, it has been found advantageous to securely adhere the gasket material 200 to the mounting cup 110. It is therefore preferred to bond the gasket to the channel of the mounting cup by a thermally activated adhesive. The adhesive can be applied to the inner surface of the sleeve gasket by extrusion, as is known in the art. Preferably, the thermal adhesive is a mixture of about 64.67% Exxon Escor acid terpolymer ATX 325, about 35.67% DNDA-7340 Natural 7 LLDPE, available from Union Carbide and 0.66% H. Kohnstamm PB 3962 blue dry colorant. The thickness of the thermal adhesive layer is preferably about 0.00075 inches. The use of the thermal adhesive is discussed in more detail in U.S. Ser. No. 07/814,113. Other means for resisting dislodgement of the gasket from the channel of the mounting cup, such as radial compressive deformations as disclosed in U.S. Pat. No. 4,599,198, may be utilized as well.

Typical property data for ATX 325 appear below:

| Ingredients | Amounts (%) |
|---|---|
| Base paste composition | 81.1661 |
| 1-propanol | 0.6459 |
| Cyclohexanol | 0.1742 |
| $SiO_2$ dispersion | soN8searchfwdRight Arrow.Shift-Up.pad Right.l-d.assigntokey |
| assigntokey,Ctrl-z.h R buffersbuflisteditfileeditnextbuffereditprevbufferdeletecurrbufferbadkeymousebuflistassigntokey | |

To form the preferred gasket of the invention, about 57% by weight of DNDA-7340 LLDPE and about 43% by weight of Altaven TM HDPE 6200B were added to a 1 D Bandury Mixer with a capacity of 30 pounds and mixed for about 2.5 minutes. Such a mixer is available from Farrel Machinery, for example. The mixing started at room temperature and reached 380°–400° F. by the end of the mixing period. The mixture was then conveyed to a Farrel 4½ inch extruder, preheated to about 400°–420° F. The mixture was discharged from the extruder at a rate of about 600 pounds per hour to a cooling trough and a Cumberland Strand Pelletizer, available from Cumberland, Inc. The pelletized mixture was later converted into a sleeve gasket by extrusion, as is known in the art. The sleeve gasket should be visually inspected to ensure that the gasket thickness is uniform. Thinned areas of the sleeve can interfere with the integrity of the seal, causing displacement of the gasket prior to clinching, or leaks.

To form the preferred thermal adhesive, about 64.67% by weight of ATX 325, about 35.67% by weight of DNDA-7340 LLDPE and 0.55% by weight of H. Kohnstamm PB 3962 blue colorant were added to the Banbury mixer and mixed for 2 minutes, up to 300°–320° F. The mixture was then conveyed to an extruder and extruded at a rate of about 600 pounds per hour at between 300°–320° F. It was then pelletized as above. The thermal adhesive and sleeve gasket were coextruded into a tool where the layers were merged, as is known in the art. The gasket material was approximately 0.014 inches thick while the layer of thermal adhesive, which is located on the inside surface of the sleeve gasket material, was approximately 0.00075 inches thick. The sleeve gasket should be visually inspected to ensure that the thermal adhesive has been applied evenly.

The use of protrusions 220 on the gasket 200 of the present invention has been found to prevent dislodgement of the mounting cup 110 by the dip tube 3 as shown in FIG. 1, securing the mounting cup 110 to the container bead 190 prior to undercap filling. This obviates the need for the protrusions 14*a*, shown in FIGS. 1–2. The additional manufacturing step required to add the protrusions 14*a* to the mounting cup are eliminated, and the integrity of the cup and container is maintained.

Another aspect of the present invention is particularly applicable where the product is dissolved in the propellant prior to filling. The mixture of product and propellant is inserted into the container by the undercap filling process at low pressure, in a higher total volume than when only propellant is inserted. In such cases, it has been found advantageous to maintain the gasket of the invention on the container bead 190 while the mounting cup is raised off the bead by the suction generated during the evacuation phase of the filling process. A thermal adhesive, or other such means for securing the gasket to the mounting cup, would not then be used. The gasket still adheres to the mounting cup sufficiently to prevent dislodgement of the mounting cup 110 by the dip tube 3, as shown in FIG. 1. During evacuation, however, suction lifts the mounting cup off of the gasket, which remains secured to the container bead by the protusions 220. After the propellant is forced into the container, the mounting cup is repositioned onto the gasket 200 and container bead 190, and is then clinched. It has been found that the gasket 200 will provide a more reliable and consistent seal when the mounting cup is repositioned on the gasket than if the gasket had been adhered to the mounting cup itself. It is believed that the high volume of material inserted into the container gradually disengages the gasket from the mounting cup, despite the use of a thermal adhesive, causing a blown gasket or a leak.

The protrusion of the invention can be formed by the apparatus and process disclosed in the '525 and '948 patents, which are discussed above and incorporated by reference herein. A single station gasket mounting cup assembly machine is utilized instead of the six station assembly machine shown in FIG. 3 of the '948 patent. It has been found that the sleeve gasket material may be positioned on a single mounting cup faster and more accurately than if sleeve gasket material is concurrently positioned on six mounting cups. In addition, higher temperatures are currently used than those disclosed in these patents. A temperature of 170° F., as measured on the raceway about 1 foot from the punch station, less than one second after the final positioning of the gasket within the channel of the mounting cup, (a convenient point to monitor temperature), is preferred. This is disclosed in more detail in U.S. Ser. No. 07/814,113.

The punch utilized in these patents can be modified to provide a series of lugs corresponding to the number of protusions to be provided. The lugs are opened sections of the punch with shoulders lower than that of the rest of the punch. We have been utilizing six such lug sections.

Figure 7C:
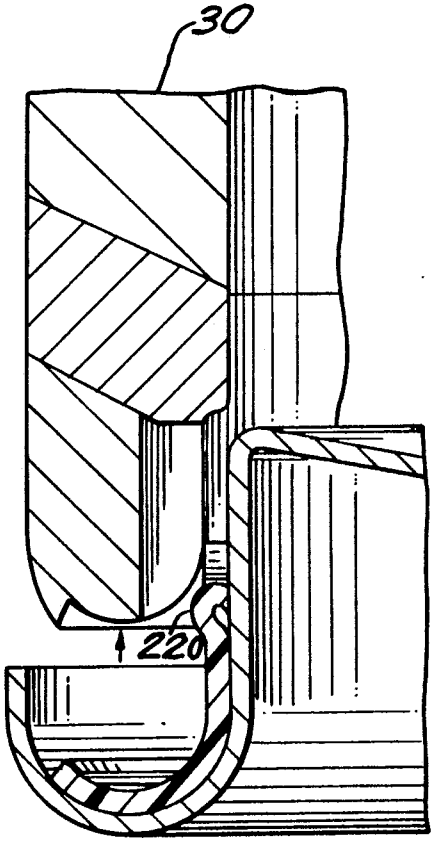
Figure 7B:
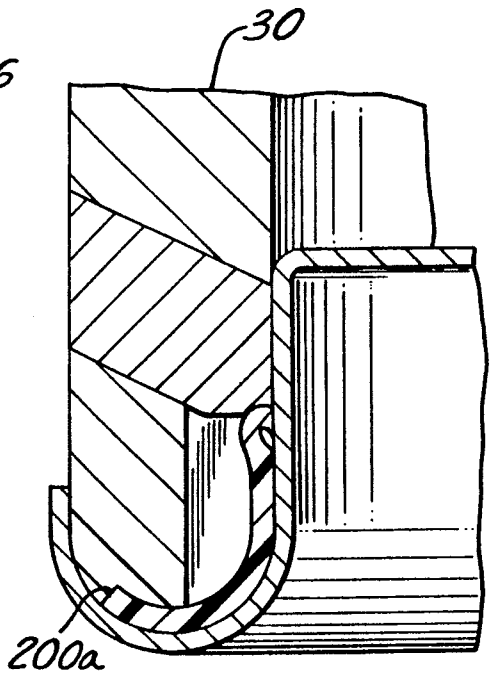
Figure 7A:
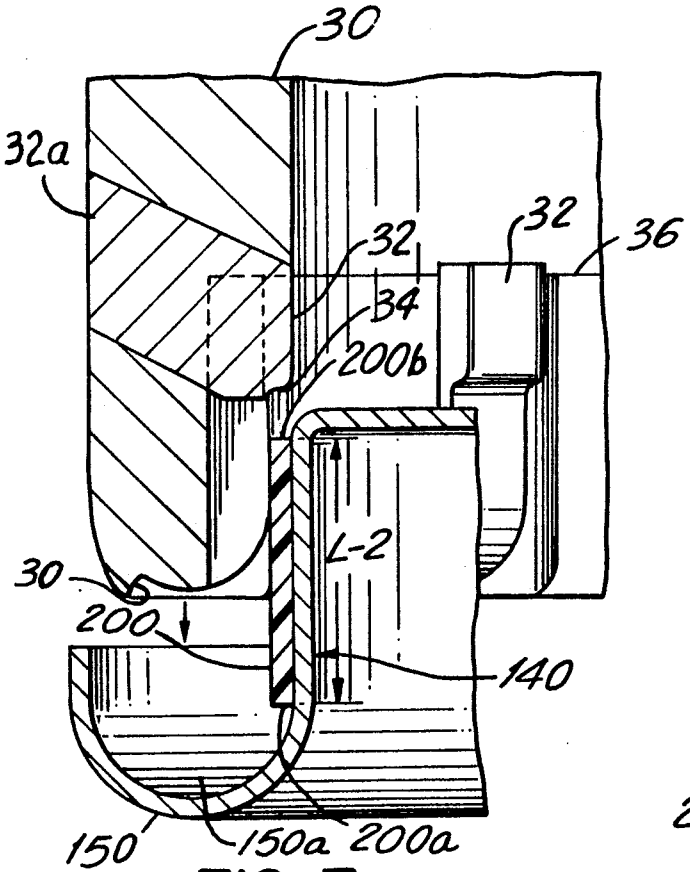

FIGS. 7*a–c* are cross-sectional views of the punch 30 and lug 32, showing the position of the gasket 200 on the skirt 140 of mounting cup 110 after the sleeve gasket is positioned on the mounting cup and cut, as discussed in the '525 and '948 patents. As shown in FIG. 7*a* and discussed above, the length "L-2" of the gasket is preferably 0.275 inches. The lug 32 preferably has a contoured shoulder 34 which engages the top of the second portion 200*b* of the sleeve 200. Another lug 32 is shown behind the mounting cup in FIG. 7*a* for forming a protrusion in the location. The lugs 32 can be formed by pins 32*a* press fit into recesses in the punch, as is known in the art and shown in these FIGURES. FIG. 8 is a bottom view of the punch 30, showing six lug sections 32 and contoured shoulders 34. FIG. 9 is a front view of a lug section.

Returning to FIGS. 7*a–c*, during final positioning of the gasket 200 within the channel of the mounting cup 110, the shoulder 34 of the lug 32 engages and advances the gasket 200 along the skirt 140 into the annular concave receptor 150*a* of the mounting cup 110. As the punch 30 approaches the bottom of the channel 150, as shown in FIG. 7*a* 150, the bottom edge of extension 30*a* of the punch engages the first portion 200*a* of the gasket 200, preventing its further advance and actually forcing it slightly back. The punch 30 itself, however, continues to advance until it bottoms in the channel 150. As the punch 30 continues to progress downward, the lug shoulders 34 fold over the portion 200*b* of the gasket 200 beneath it, forming the protrusion 220. See FIG. 7*b*. The sides of the protrusion 220 may be slightly torn from the rest of the gasket 200 to form the protrusion 220. The extension 30*a* is preferably positioned so that the flare diameter of the gasket is at least about 1.180 inches and is preferably about 1.220 inches, as discussed above and in U.S. Ser. No. 07/814,113. The extension 30*a* also acts to prevent the punch from compressing the gasket material, forming thin regions that could weaken the seal. The height of extension 30*a* is 0.016 inches.

After engaging the first portion 200*a* of the gasket 200 and preventing further progress of the gasket, the punch preferably progresses approximately 0.050 inches, forming the protrusion 220 approximately 0.050 inches from the top of the gasket. The protrusion extends at least 0.008 inches from the outer wall of the gasket and preferably extends approximately 0.016 inches. The lug 32 is at least 0.035 inches wide and is preferably approximately 0.065 inches wide, forming a protrusion of approximately the same width. These dimensions are preferred where six protrusions are utilized. If fewer protrusion are utilized, each protrusion would need to extend out further and be wider, to provide increased support. If more than six protrusions are utilized, they may be smaller. As the punch 30 bottoms in the channel 150 of the mounting cup, a circumferential shoulder 36 between the lug sections of the punch 30 engages the top 200*b* of the gasket 200 where the protrusions are not formed, ensuring that the gasket is straight. See FIGS. 7–9.

What is claimed:

1. A gasket for sealing a channel of a mounting cup to a bead of a container, comprising gasket material having a first and second portion, the first portion for being positioned at least partially within the channel portion of a mounting cup and the second portion having an inner surface and an outer surface, the inner surface for being positioned contiguous to a smooth skirt of the mounting cup, and at least one self supporting protrusion associated with the second portion of the gasket material, the protrusion extending radially outward from the second portion.

2. The gasket of claim 1 wherein the protrusion is located proximate an end of the second portion opposite the first portion.

3. The gasket of claim 2 wherein the protrusion is located approximately 0.050 inches from the end of the second portion of the gasket.

4. The gasket of claim 1 further comprising a plurality of protrusions arranged annularly around the second portion of the gasket.

5. The gasket of claim 1 comprising six protrusions equidistantly positioned around the gasket.

6. The gasket of claim 5 wherein the protrusions extend approximately 0.016 inches from the gasket.

7. The gasket of claims 1 or 5 further comprising a thermally activated adhesive on a surface of the gasket to be in contact with the mounting cup.

8. The gasket of claim 1 wherein the gasket material is in the form of a sleeve.

9. A gasketed mounting cup comprising a panel, a smooth skirt integral with and depending from a periphery of the panel, the skirt being outwardly flared to form an annular channel for receiving a container bead that defines a container opening, and a gasket comprising a first and second portion, the first portion being at least partially within the channel of the mounting cup and the second portion being in contact with the skirt of the mounting cup, the gasket further comprising at least one self supporting protrusion associated with the second portion of the gasket, the protrusion extending radially outward from the second portion such that the protrusion can engage the container bead, maintaining the gasket on the container bead during a filling operation.

10. The gasketed mounting cup of claim 9 wherein the protrusion comprises a folded over section of the gasket.

11. The gasketed mounting cup of claim 10 further comprising a plurality of protrusions equidistantly positioned about the second portion of the gasket.

12. The gasketed mounting cup of claim 10 wherein the protrusions are located approximately 0.050 inches from an end of the second portion.

13. The gasketed mounted cup of claim 9 comprises six protrusions equidistantly positioned around the gasket.

14. The gasketed mounting cup of claim 13 wherein the protrusions extend approximately 0.016 inches from the gasket.

15. The gasketed mounting cup of claim 9 or 13 wherein the gasket is adhered to the channel of the mounting cup with a thermally activated adhesive, the protrusions maintaining the gasket and mounting cup on the container bead during a filling operation.

16. The gasket of claim 9 wherein the gasket material is in the form of a sleeve.

17. A gasketed mounting cup comprising a panel, a smooth skirt integral with and depending from a periphery of the panel, the skirt being outwardly flared to form an annular channel for receiving a container bead that defines a container opening, and a gasket comprising a first and second portion, the first portion being at least partially within the channel of the mounting cup and the second portion being in contact with the skirt of the mounting cup, the second portion of the gasket comprising a self supporting, folded over section of the gasket extending outwardly and away from the skirt, for engaging the container bead and maintaining the mounting cup in position on the container bead prior to clinching of the mounting cup to the container bead.

18. The gasketed mounting cup of claim 17 wherein the second portion comprises a plurality of folded over sections of the gasket.

19. The gasketed mounting cup of claim 17 wherein there are six equidistantly positioned folded over sections of the second portion of the gasket.

20. The gasketed mounting cup of claim 17 wherein the folded over section of the second portion of the gasket is located approximately 0.050 inches from an end of the second portion.

21. The gasket of claim 17 wherein the folded over section extends approximately 0.016 inches from the gasket.

22. The gasket of claim 17 further comprising a thermally activated adhesive on a surface of the gasket in contact with the mounting cup.

23. The gasketed mounting cup of claim 17 wherein the gasket is in the form of a sleeve.

* * * * *